US009146080B2

(12) United States Patent
Parida et al.

(10) Patent No.: US 9,146,080 B2
(45) **Date of Patent: *Sep. 29, 2015**

(54) BLAST/IMPACT MITIGATION SHIELD

(75) Inventors: Basant K. Parida, Bellingham, MA (US); Norman Dana, Albion, RI (US); Abdullatif K. Zaouk, Jamaica Plain, MA (US)

(73) Assignee: Foster-Miller, Inc., Waltham, MA (US)

( * ) Notice: Subject to any disclaimer, the term of this patent is extended or adjusted under 35 U.S.C. 154(b) by 44 days.

This patent is subject to a terminal disclaimer.

(21) Appl. No.: 13/507,051

(22) Filed: May 31, 2012

(65) Prior Publication Data

US 2013/0319215 A1 Dec. 5, 2013

(51) Int. Cl.
*F41H 7/04* (2006.01)
*F41H 5/007* (2006.01)

(52) U.S. Cl.
CPC ..... *F41H 7/042* (2013.01); *F41H 5/007* (2013.01); *Y10T 29/49826* (2015.01)

(58) Field of Classification Search
CPC ..... F41H 7/00; F41H 7/042; F41H 5/007; Y10T 29/49826
USPC ..... 296/187.07, 187.08; 89/36.02, 36.07, 89/918
See application file for complete search history.

(56) References Cited

U.S. PATENT DOCUMENTS

| | | | |
|---|---|---|---|
| 2,997,325 | A | 8/1961 | Peterson |
| 3,006,484 | A | 10/1961 | Pringiers |
| 3,053,526 | A | 9/1962 | Kendall |
| 3,139,290 | A | 6/1964 | Swick |
| 3,209,864 | A | 10/1965 | Boyd |
| 3,365,189 | A | 1/1968 | Carlson |
| 3,659,835 | A | 5/1972 | Peterson |
| 3,713,641 | A | 1/1973 | Kendall |
| 3,741,560 | A | 6/1973 | Schaller |
| 3,747,915 | A | 7/1973 | Hall |
| 3,773,187 | A | 11/1973 | Carlson |
| 3,847,252 | A | 11/1974 | Casciola |
| 3,876,044 | A | 4/1975 | Kendall et al. |
| 3,913,707 | A | 10/1975 | Wastenson et al. |
| 4,040,523 | A | 8/1977 | Carle et al. |
| 4,403,012 | A | 9/1983 | Harpell et al. |

(Continued)

FOREIGN PATENT DOCUMENTS

| | | | |
|---|---|---|---|
| DE | 10 2009 029 814 | B4 | 1/2011 |
| JP | 60252832 | A | 12/1985 |

(Continued)

OTHER PUBLICATIONS

Written Opinion of the International Searching Authority for PCT Application No. PCT/US2013/57816 mailed Nov. 15, 2013 (nine (9) pages).

(Continued)

*Primary Examiner* — Joseph D Pape
(74) *Attorney, Agent, or Firm* — Iandiorio Teska & Coleman, LLP

(57) ABSTRACT

A blast/impact mitigation shield includes, in one example, a first body including a damping material in a solid state and which transitions to a viscous fluid state when stressed beyond a critical stress and a second body including damping material in a solid state and which transitions to a viscous fluid state when stressed. A plunger plate has blades extending outwardly therefrom and is located between the first and second bodies.

16 Claims, 7 Drawing Sheets

(56) References Cited

U.S. PATENT DOCUMENTS

| | | | | |
|---|---|---|---|---|
| 4,778,633 | A | 10/1988 | Kiang et al. | |
| 5,349,893 | A | 9/1994 | Dunn | |
| 5,354,605 | A | 10/1994 | Lin et al. | |
| 5,875,875 | A | 3/1999 | Knotts | |
| 6,050,211 | A | 4/2000 | Yamaguchi | |
| 6,135,252 | A * | 10/2000 | Knotts | 188/374 |
| 6,393,999 | B1 | 5/2002 | Schneider | |
| 6,477,934 | B1 | 11/2002 | Bruhn et al. | |
| 6,532,857 | B1 | 3/2003 | Shih et al. | |
| 6,807,891 | B2 | 10/2004 | Fisher | |
| 7,255,034 | B2 | 8/2007 | Strassgurtl et al. | |
| 7,806,038 | B2 | 10/2010 | Duke | |
| 7,845,266 | B2 | 12/2010 | Duke et al. | |
| 7,908,959 | B2 | 3/2011 | Pavon | |
| 7,987,762 | B2 | 8/2011 | Joynt et al. | |
| 7,997,181 | B1 | 8/2011 | Tunis et al. | |
| 7,997,182 | B1 | 8/2011 | Cox | |
| 8,033,208 | B2 | 10/2011 | Joynt et al. | |
| 8,146,477 | B2 | 4/2012 | Joynt | |
| 8,418,597 | B2 | 4/2013 | Pavon | |
| 2004/0206591 | A1 | 10/2004 | Smelser | |
| 2006/0013977 | A1 | 1/2006 | Duke et al. | |
| 2007/0144337 | A1 | 6/2007 | Zhang et al. | |
| 2008/0090933 | A1 | 4/2008 | Muratoglu et al. | |
| 2008/0111396 | A1 | 5/2008 | Barbe et al. | |
| 2009/0065462 | A1 | 3/2009 | Gansweidt | |
| 2010/0170386 | A1 | 7/2010 | Bhatnagar et al. | |
| 2010/0173117 | A1 | 7/2010 | Duke et al. | |
| 2010/0307327 | A1 | 12/2010 | Gettle | |
| 2010/0307329 | A1 | 12/2010 | Kaswen et al. | |
| 2011/0114427 | A1 | 5/2011 | Parida et al. | |
| 2011/0148147 | A1 | 6/2011 | Tunis et al. | |
| 2011/0169240 | A1 | 7/2011 | Schreiner et al. | |
| 2011/0259185 | A1 | 10/2011 | Berning et al. | |
| 2012/0055324 | A1 | 3/2012 | Pepka | |
| 2012/0152098 | A1 | 6/2012 | Howland et al. | |
| 2012/0186436 | A1 | 7/2012 | Parida et al. | |
| 2012/0204711 | A1 | 8/2012 | Engleman et al. | |
| 2013/0152774 | A1 | 6/2013 | Gonzalez | |
| 2013/0319215 | A1 | 12/2013 | Parida et al. | |

FOREIGN PATENT DOCUMENTS

| | | |
|---|---|---|
| JP | 2007231241 | 9/2007 |
| WO | WO 2011/059471 A1 | 5/2011 |

OTHER PUBLICATIONS

Jauffres et al., "Microstructural origin of physical and mechanical properties of ultra high molecular weight polyethylene processed by high velocity compaction", Elsevier Ltd. Polymer 48, (2007), pp. 6374-6383.

U.S. Appl. No. 13/604,019, Parida et al.

U.S. Appl. No. 13/604,248, Parida et al.

U.S. Appl. No. 13/604,288, Parida et al.

Written Opinion of the International Searching Authority for PCT Application No. PCT/US2012/058420 mailed Jul. 1, 2013 (five (5) pages).

Written Opinion of the International Searching Authority for PCT Application No. PCT/US2013/57814 mailed May 2, 2014 (four (4) pages).

Written Opinion of the International Searching Authority for PCT Application No. PCT/US2013/57821 mailed May 2, 2014 (seven (7) pages).

Written Opinion of the International Searching Authority, International Application No. PCT/US2010/002793, mailed Dec. 30, 2010 (five(5) pages).

* cited by examiner

BLAST/IMPACT MITIGATION SHIELD

RELATED APPLICATIONS

This application is related to U.S. patent application Ser. No. 12/925,354 filed Oct. 19, 2010 which claims the benefit of and priority to U.S. Provisional Application Ser. No. 61/281,314 filed Nov. 16, 2009 under 35 U.S.C. §§119, 120, 363, 365, and 37 C.F.R. §1.55 and §1.78 each of which is incorporated herein by this reference. This application is also related to U.S. patent application Ser. No. 13/385,486 filed Feb. 22, 2012, and incorporated herein by this reference.

FIELD OF THE INVENTION

The subject invention relates to vehicle underbody blast effects and ballistic damage mitigation.

BACKGROUND OF THE INVENTION

Mines and improvised explosive devices (IEDs) can damage vehicles and injure or kill vehicle occupants. Some work has been carried out to detect and disable mines and IEDs. Other engineering concerns tailoring vehicles to be more resistant to the blast of a mine or IED. Examples include the V-hull of the MRAP and STRYKER vehicles designed to deflect away a part of the explosive forces originating below the vehicle. See for example, published U.S. Patent Application Nos. 2011/0169240 and 2011/0148147, incorporated herein by this reference.

There is a limit, though, to how much of the explosive blast can be deflected. And, some vehicles cannot be engineered to include a V-hull. Still other vehicles cannot be equipped with heavy armor. The military HMMWV vehicle, for example, is and must remain configured to quickly traverse difficult terrain.

SUMMARY OF THE INVENTION

In examples of this invention, a light weight effective blast shield is designed for use as a vehicle underbody design or attachment kit for blast mitigation due to a land mine or IED explosion. The shield is designed to partially deflect away the pressure wave of a blast and/or absorb a significant part of the blast energy by use of mechanisms and a phase changing material.

Featured is a blast/impact shield comprising a first body including a damping material in a solid state and which transitions to a viscous fluid state when stressed. A second body includes damping material in a solid state and which transitions to a viscous fluid state when stressed. A plunger plate has blades extending outwardly therefrom is between the first and second bodies. In one version, the first body is disposed adjacent a hull and the plunger plate blades are oriented toward the first body. One or both of the first and second bodies may include multiple layers of damping material and/or a slab of damping material.

Another blast/impact shield includes a first body of damping material in a solid state and which transitions to a viscous fluid state when stressed and a plunger plate with blades extending outwardly therefrom adjacent the first body for transitioning material the first body from a solid to a viscous fluid state locally when the blades of the plunger plate are driven into the body. The first body can be disposed adjacent the hull or the plunger plate can be disposed between the hull and the first body.

Still another blast/impact shield features phase change material in a solid state and configured in response to a blast when adjacent a hull to transition from a solid state to a viscous fluid state at least on or at one surface thereof reducing the effects of a pressure wave of the blast and the inertia of any soil accelerated by the blast.

The invention also features a blast mitigation method comprising fabricating a body of solid material which transitions from a solid state to a viscous fluid state when stressed attaching the body to the undercarriage of a vehicle the material of the body transitioning from a solid state to a viscous fluid state when an explosion occurs proximate the body and the body absorbing at least some energy from the explosion mitigating its impact on the vehicle.

The method may include placing the body in a frame. In one version, a plunger plate with blades extending outwardly therefrom is disposed adjacent the body and oriented such that the blades are in or adjacent the body. Another version includes adding to the undercarriage of the vehicle a second body of solid material which transitions to a viscous fluid state when stressed. Now, the plunger plate can be disposed between the first and second bodies.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
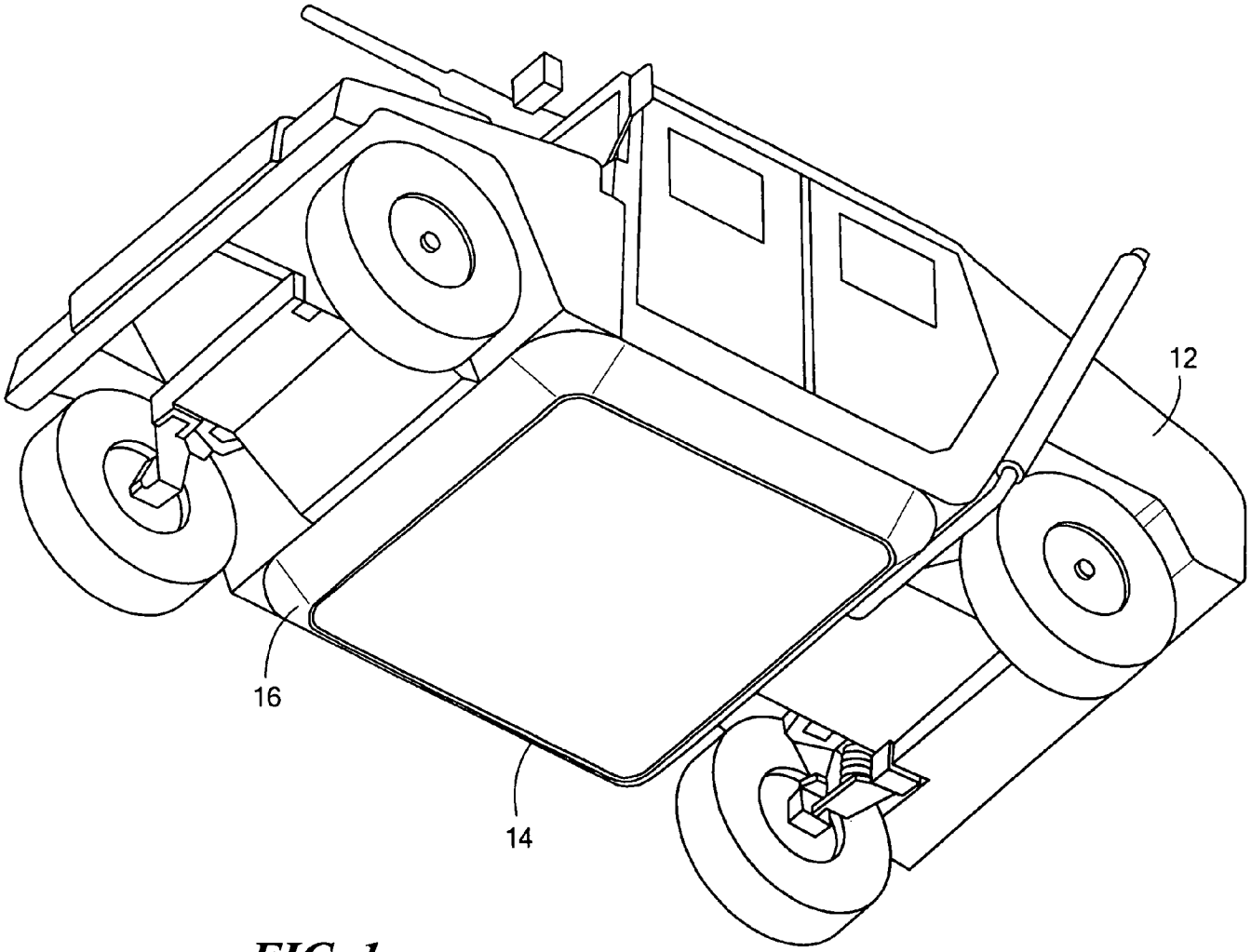
FIG. 1 is a schematic three dimensional view showing the undercarriage of a military vehicle equipped or fitted with a blast shield in accordance with an example of the invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

Figure 2:
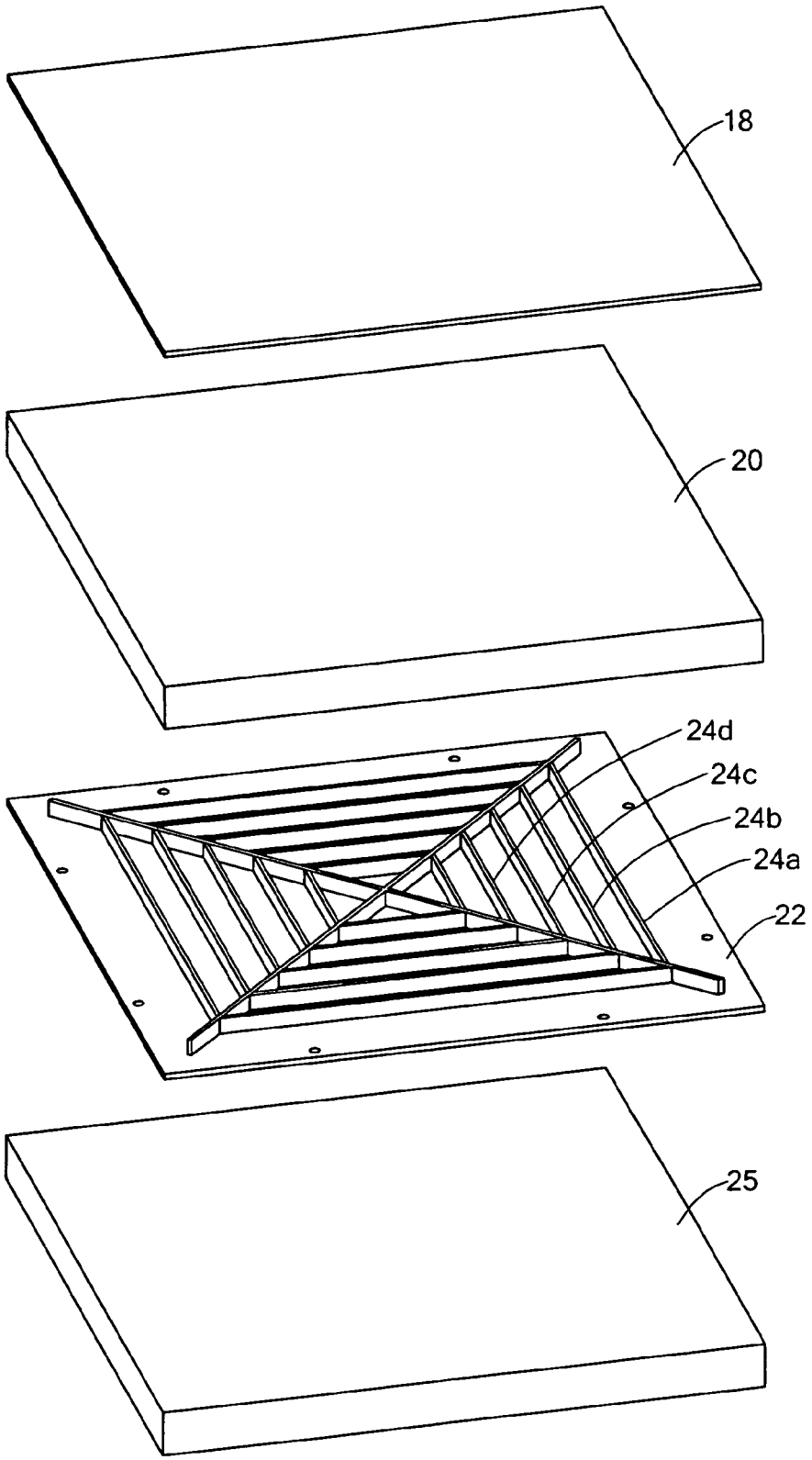
FIG. 2 is a schematic exploded front view showing the primary components associated with one example of a blast shield of the invention.
Figure 3:
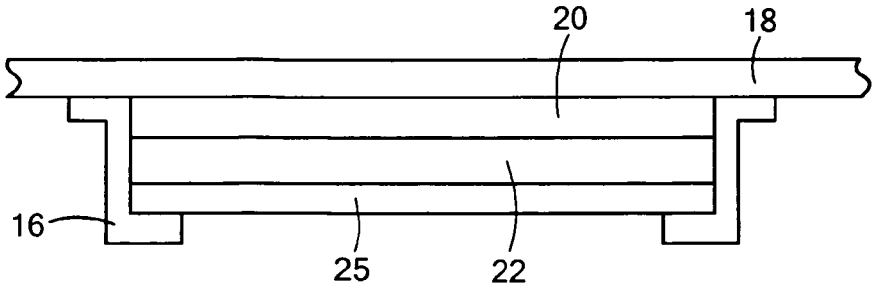
FIG. 3 is a schematic cross sectional view of the shield of FIG. 1 positioned under a vehicle hull using a frame in accordance with examples of the invention.

FIG. 1 shows military vehicle 12 equipped with shield 14 including, in this particular example, frame 16 bolted to the under carriage "hull" of the vehicle. FIG. 2 shows one version (without the frame) where vehicle hull is depicted at 18. First body 20 abuts hull 18 and here is a slab of ultra high molecular weight polyethylene (UHMW-PE) material which transitions from a solid state to a viscous fluid state when sufficiently stressed. First body 20 could, in other embodiments, include plies of UHMW-PE material and/or be divided into sections. Plunger plate 22, typically metal, has concentric blades 24*a*-24*d* abutting the bottom surface of slab 20 in this design. Other extruded sections may also be used. See also FIG. 5. Second body 25, FIGS. 2-3 is also included, in this example, abutting the bottom of plate 22. Body 25 is also a one to three inch thick slab of UHMW-PE material which transitions from a solid state to a viscous fluid state when stressed.

When vehicle 12, FIG. 1 equipped with such an undercarriage shield drives over a mine or IED which explodes, body 25, FIG. 2 primarily functions to absorb energy from the blast caused by soil impacting the body which in response transitions from a solid state to a viscous fluid state. The UHMW-PE material will blister, crack, and shred and become heavily embedded with soil.

The combination of plunger plate 22 and body 20 functions to absorb the blast pressure as the blades 24 are driven into body 20 and it changes from a solid to a viscous fluid state locally near the blades in response due to the pressure of the blast. Plate 22 may deform slightly and the blades of plate 22 will embed in body 20 and cut or partially cut into body 20.

FIG. 3 shows the completed assembly. When a critical stress magnitude is reached, the UHMW-PE material in bodies 20 and 25 undergoes a phase transition from a solid to a viscous fluid state. This phase transition occurs at or above a critical compression stress magnitude. Upon impact, plunger blades 24*a*-24*d* penetrates into UHMW-PE slab 20. With an increasing impact force magnitude, the UHMW-PE material undergoes a phases transition at or above the critical stress. As the UHMW-PE material ahead of and adjacent to the plunger blades transitions into a viscous fluid state, the resisting force on the plunger blades drops sharply to a lower value. The plunger blades then continue to move through the material with a gradual further rise in force magnitude until a significant amount of the impact energy is absorbed.

Considering the complete assembly of the blast/impact mitigation shield fitted to the underbody of a vehicle, schematically shown in FIG. 3, the physics of the blast effects mitigation my be explained as follows.

When a land-mine or and IED buried at certain depth in soil is detonated under a vehicle, first the mass of soil above the mine or IDE strikes the bottom surface of the UHMW-PE body 25 with extremely high velocity. This extremely high momentum of soil is almost immediately reduced to zero as the soil mass impinges on the UHMW-PE body 25. The resulting normal force is of such high magnitude that in all areas of soil impingements the critical stress required for phase transition of UHMW-PE is crossed. The soil mass gets embedded into the phase transitioned viscous material of the UHMW-PE body and in this process a part of the blast energy is absorbed by the body 25. The blast pressure, whose magnitude depends on the high explosive (HE) charge mass contained within the mine/IED, applies an extremely high impact force on the base of plunger plate 22, which then forces all the plunger blades to penetrate into the UHMW-PE body 20. The resulting stress magnitudes in the UHMW-PE material in front of and surrounding the blades exceed the critical compressive stress magnitude for phase transition of UHMW-PE material. The blades of plunger plate 22 therefore penetrate into the locally transformed viscous material of UHMW-PE body 20, which is supported against the application of normal force by the hull or the armor plate 18 of the vehicle. The work done in this process of plunger plate 22 displacement against the resistive force offered to penetration of blades by the UHMW-PE body 20 is quite significant and this accounts for a large amount of blast energy absorption. The remaining blast energy would cause the vehicle to be thrown up in the air. The height of throw depends on the remaining energy available following significant amount of energy absorbed by the blast/impact mitigation shield.

The blast/impact mitigation shield therefore reduces the net vertical upward force experienced by the vehicle and its occupants. This results in relatively lower magnitude of vertical acceleration, which can be designed to remain within a certain tolerance level for a specific threat of blast impulse.

The reduction in upward vertical acceleration of a vehicle fitted with a blast/impact mitigation shield following an underbody mine/IED blast can also be explained considering the rate of change of momentum. While a vehicle with only an armor plate used as underbody hull experiences a huge change in momentum within an extremely small time interval, the same vehicle, if fitted with a blast/impact mitigation shield, will take considerably longer time interval for the change of momentum due to the work done by the plunger plate 22 on the UHMW-PE body 20. The force magnitude being proportional to the rate of change of momentum will be smaller for the latter case and so also the magnitude of vertical acceleration.

The phase change material has an extremely high heat of fusion (145-195 J/g), and thus it requires a lot of energy to transition it from a solid to a liquid state. In so doing, a lot of impact energy is dissipated.

Figure 4:
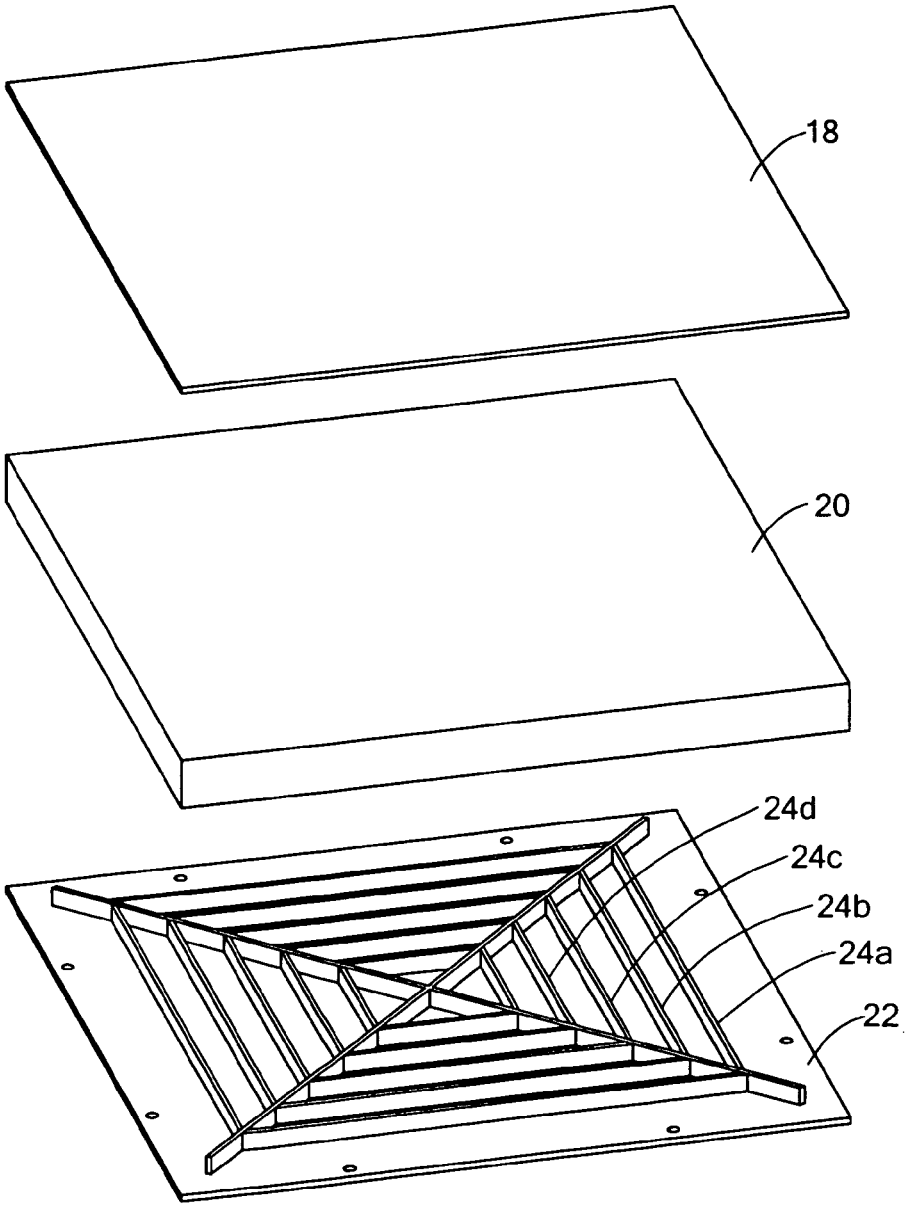
FIG. 4 is a schematic exploded three dimensional front view showing another example of a blast shield in accordance with the invention.
Figure 5:
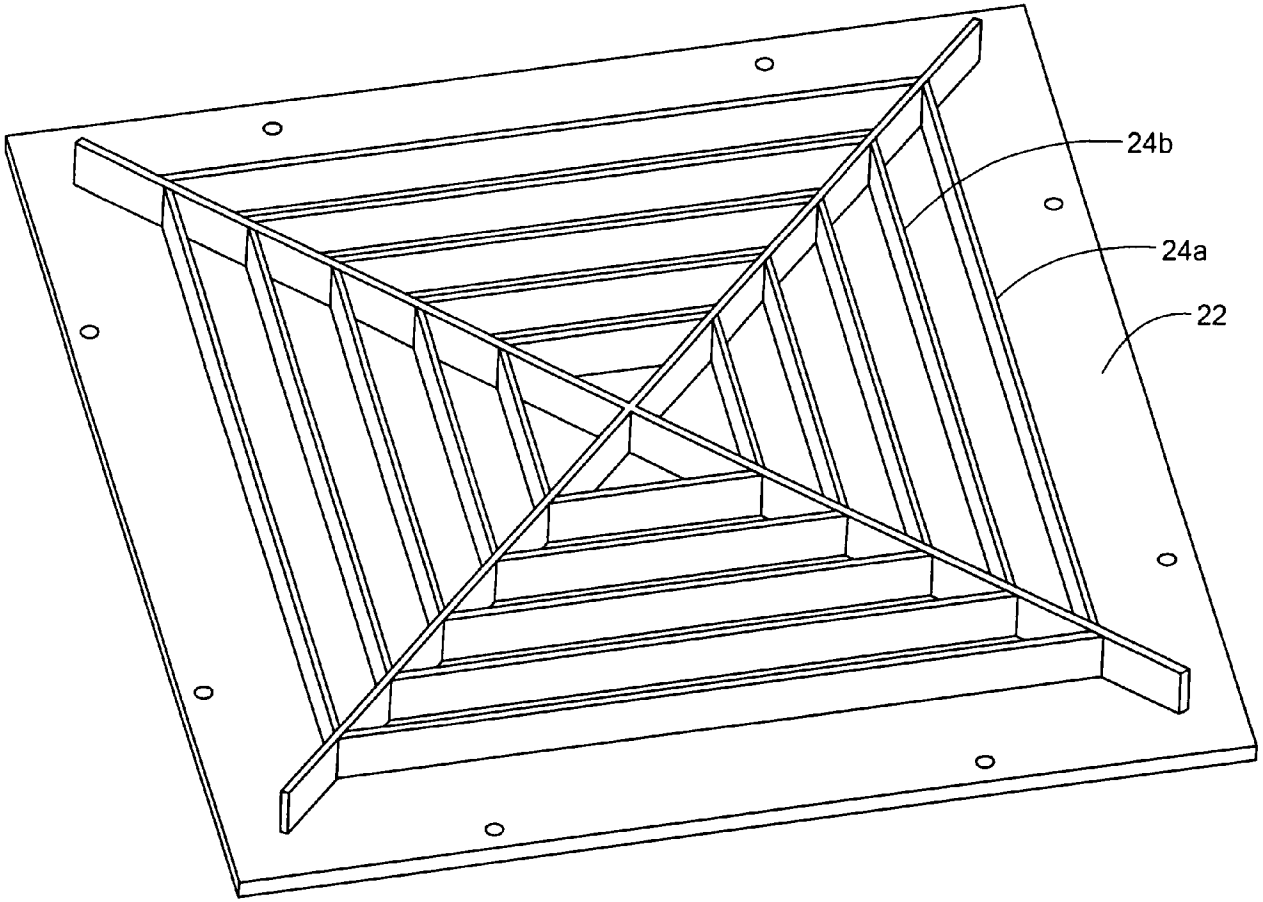
FIG. 5 is a schematic three dimensional top view showing a plunger plate in accordance with examples of the invention.

In the example of FIG. 4, second body 25 of FIG. 2 is not used. Instead, plate 22 abuts body 20 and body 20 abuts the hull or an armor plate under the vehicle 18. Again, a frame may be used. In one test of this configuration, conducted using a blast test fixture weighing 17,500 pounds, three one inch thick plies of UHMW-PE material were placed between a one-quarter inch simulated hull plate 18 and plunger plate 22 as shown in FIG. 5. 7.27 lbs. of composition C4 explosive 8" in diameter and 2¼" tall in a 24" diameter cylinder was buried with 4" of soil (50% sand, 50% clay, 12% moisture content). The standoff between plate 22 and the soil was 15.25 inches.

Upon detonation of the C4 explosive, blades 24*a*-24*d* cut thorough the first layer of body 20 but only partially embedded in the second layer of body 20. The third layer was unaffected. One-half inch thick metal plunger plate 22 was permanently deformed 1.3" and hull 18 was deformed 2.9".

Figure 6:
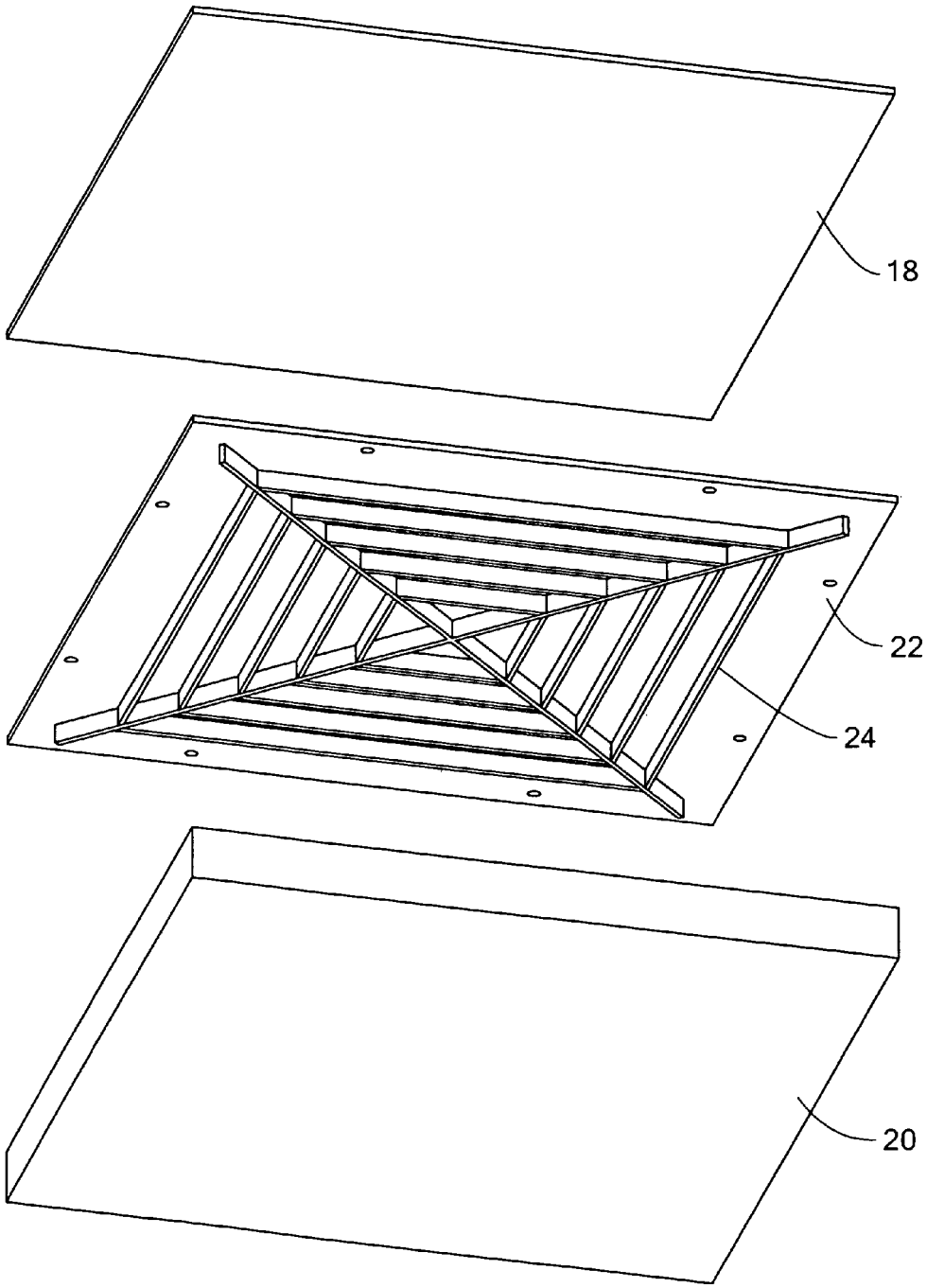
FIG. 6 is a schematic exploded three dimensional view showing another example of a blast shield in accordance with the invention.

FIG. 6 shows an option where plunger plate 22 abuts hull 18 and blades of plate 22 face the top of UHMW-PE body 20. Another stiff plate may be used below the UHMW-PE PE body 20 (not shown in FIG. 6).

In still another example, under carriage shield 14, FIG. 1 is one or more plies and/or one or more sections of UHMW-PE or similar material without a plunger plate. Frame 16 is also optional.

Six 1" layers were bolted to a ¾" thick rolled homogeneous armor (RHA) steel "hull" and tested. At a 9.25" standoff, the hull plate was permanently deformed by 2⅞". The bottom most layer of UHMW-PE material was blistered, cracked, and shredded (heavily soil embedded). The second layer of UHMW-PE material was only marginally affected and was intact, somewhat discolored since it was somewhat exposed to this soil blast. The third through sixth layers of UHMW-PE material were unaffected. With a 15.25 inch standoff using four layers, the hull plate deformed by 4". The lowest most UHMW-PE layer was intact but imbedded with soil. The second through fourth layers were unaffected.

Examples of the invention provide a new type of blast or impact absorption that utilize a novel design and unique elastic-plastic deformation behavior of ultra high molecular weight (UHMW) polyethylene or similar materials. They unexpectedly exhibit rapid absorption of kinetic energy and limit blast force magnitude through an energy absorption process and the rate of change of momentum following an impact or blast event. See also U.S. application Ser. No. 13/385,486 file Feb. 22, 2012 incorporated herein by this reference.

Featured is a blast mitigation shield comprising damping material in a solid state and which transitions from a solid to a viscous fluid state when stressed in compression above a critical stress, for example due to a blast event. A plunger plate includes blades positioned in or adjacent to the damping material to be driven into the damping material when impacted by a blast event transitioning the damping material to a viscous fluid state absorbing the impact. In other examples, the system described herein is configured as a drop platform. The "hull" described herein is thus the primary surface of the drop platform.

Blast or impact shields in accordance with the examples of the invention include one or more bodies of damping material in a solid state and which transition from a solid to a viscous fluid state when stressed in compression. Examples of the material include ultra high molecular weight polyethylene, high density polyethylene HDPE, and equivalents thereof. A constraining frame is optional. If used, the plunger plate may include extended blades which may terminate in pointed knife portions positioned at or closely adjacent to the damping material. When the plunger plate is impacted by a blast event or an impact event, the blades are driven into the damping material transitioning it locally near the blades from a solid to a viscous fluid state absorbing the energy of the blast or the impact through work done by the plunger blades. For an airdrop platform, the damping material and/or plunger blades may be secured to the bottom of a drop platform, and/or distributed as narrow strips along the perimeter of the bottom surface.

Figure 7:
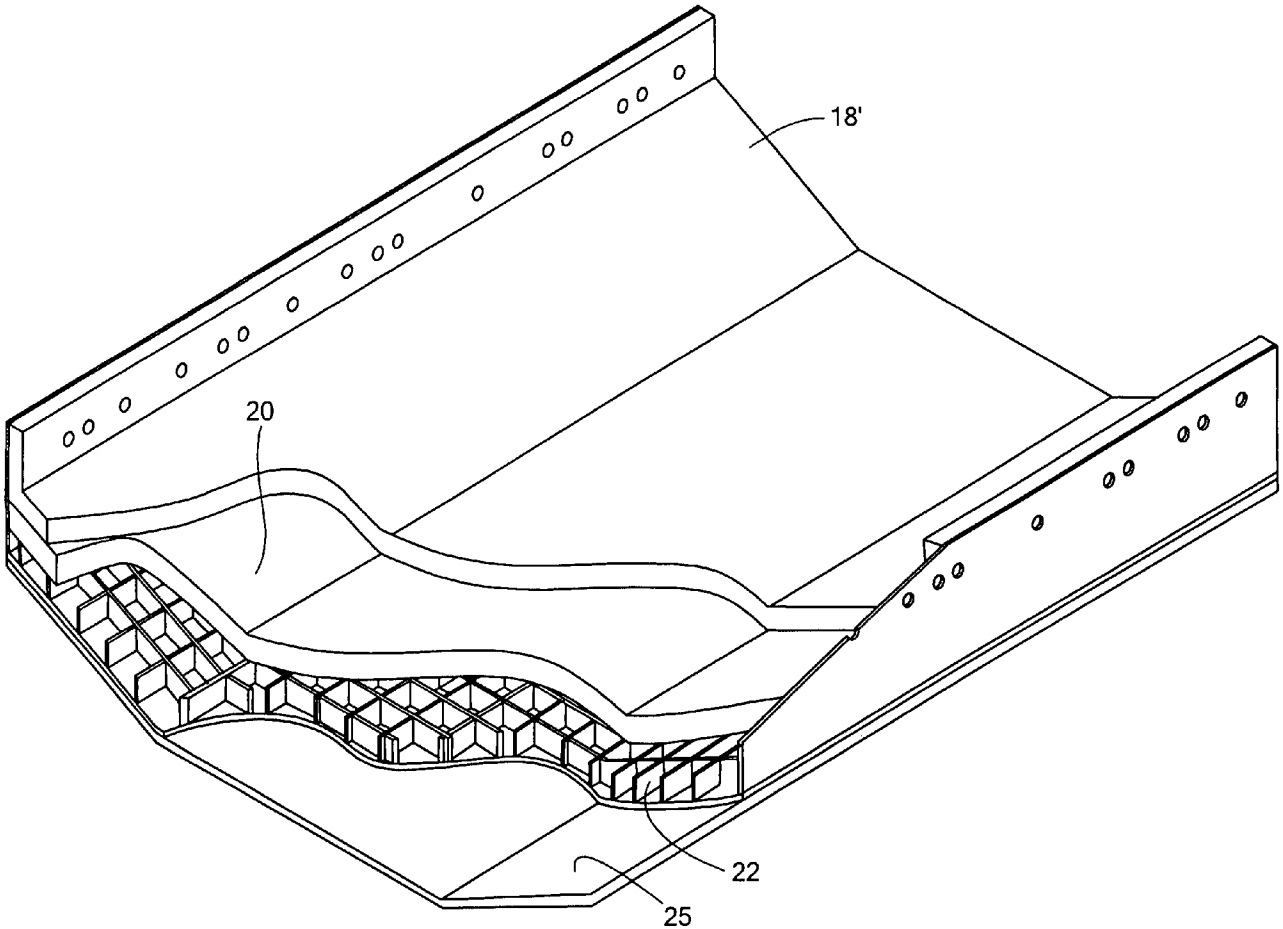
FIGS. 7-8 are schematic views of truncated V-hull blast shields.
Figure 8:
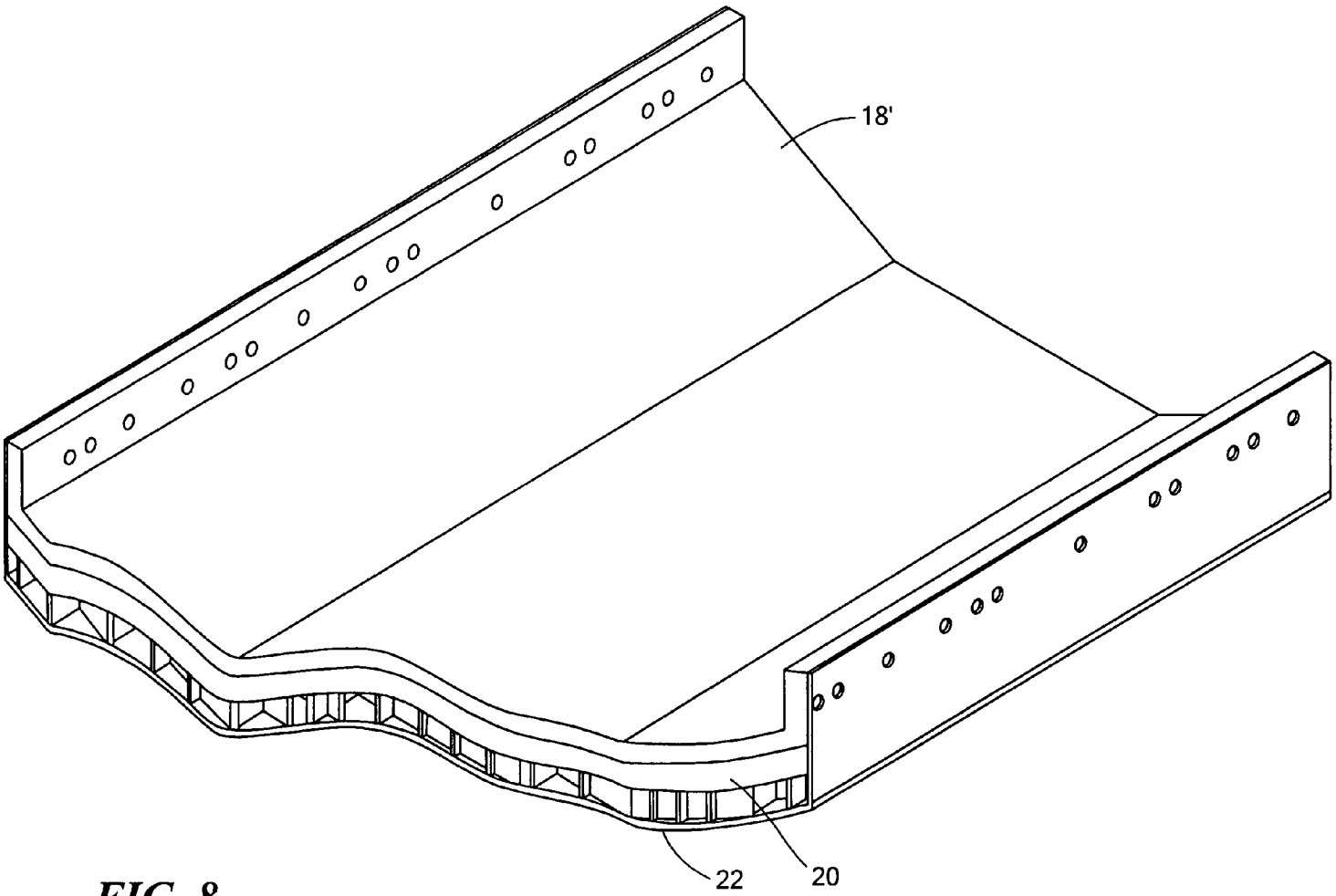

The blast/impact mitigation shield can be designed for a vehicle having flat bottom hull as schematically shown in FIG. 1 and also for a vehicle having a "V-shaped" hull or a "double V-shaped hull". FIGS. 7 and 8 schematically show examples of a vehicle underbody truncated V-hull 18' and corresponding truncated V-shaped blast/impact mitigation shield design. The blast/impact mitigation shield can be designed and configured to meet the same objective of blast effect mitigation.

Thus, although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A blast impact mitigation shield comprising:

a first slab adjacent a vehicle hull and including a damping material in a solid state and which transitions by a phase change to a viscous fluid state when critically stressed by an impact;

a second spaced slab including damping material in a solid state and which transitions by a phase change to a viscous fluid state when critically stressed by the impact; and a plunger plate between the first and second slabs, the plunger plate having blades extending outwardly to contact one of the first slab and the second slab in response to the impact.

2. The shield of claim 1 in which the plunger plate blades are oriented toward the first slab.

3. The shield of claim 1 in which one or both of the first and second slabs include multiple layers of damping material.

4. A blast impact shield comprising:

a first slab including damping material in a solid state and which transitions by a phase change to a viscous fluid state when stressed by the impact; and a plunger plate with blades extending adjacent the first slab for transitioning material of the first slab via the phase change from a solid to a viscous fluid state locally near the blades when the blades of the plunger plate are driven into the first slab.

5. The shield of claim 4 in which the first slab is disposed adjacent a hull of a vehicle.

6. The shield of claim 4 in which the plunger plate is disposed between a hull and the first slab.

7. The shield of claim 4 further including a second slab including material in a solid state and which transitions by a phase change to a viscous fluid state when critically stressed and on an opposite side of the plunger plate from the first slab.

8. A blast impact shield comprising:

at least a first slab including a phase change material in a solid state and configured in response to a blast when adjacent a surface of a hull to transition by a phase change from a solid state to a viscous fluid state at least on or at one surface of the at least one first slab when critically stressed by the impact, reducing the effects of a pressure wave of the blast and the inertia of any soil accelerated by the blast; and a plunger plate having blades extending to contact the first slab in response to the impact to critically stress the first slab.

9. The shield of claim 8 further including a second slab including damping material in a solid state and configured to transition by a phase change to a viscous fluid state when stressed beyond a critical stress.

10. The shield of claim 9 in which the plunger plate is disposed between the first and second slabs.

11. A blast mitigation method comprising:

attaching to the undercarriage of a vehicle a slab of solid material which transitions by a phase change from a solid state to a viscous fluid state when critically stressed by an impact from a blast; and disposing a plunger plate having blades adjacent the slab, the blades extending to a major surface of the slab, the blades having edges adjacent the slab;

the material of the slab, transitioning from a solid state to a viscous fluid state when a blast occurs proximate the slab;

the slab absorbing at least some energy from the blast mitigating an impact from the blast on the vehicle.

12. The method of claim 11 in which fabricating includes placing the slab in a frame.

13. The method of claim 11 further including adding, to the undercarriage of the vehicle, a second slab of solid material which transitions by a phase change to a viscous fluid state when critically stressed.

14. The method of claim 13 in which the plunger plate is disposed between the first and second slabs.

15. A blast impact mitigation shield comprising:

a first body including a damping material in a solid state and which transitions to a viscous fluid state when critically stressed;

a second body including damping material in a solid state and which transitions to a viscous fluid state when critically stressed, the second body configured to primarily absorb impact energy from a blast; and a plunger plate with blades extending outwardly therefrom between the first and second bodies, the first body configured to absorb additional energy from the blast as the blades are driven into the first body by pressure from the blast.

16. A blast mitigation fabrication method comprising:

fabricating a body of solid material which transitions by a phase change from a solid state to a viscous fluid state when critically stressed;

disposing a plunger plate having blades adjacent the body;

fabricating a second body of solid material which transitions by a phase change from a solid state to a viscous fluid state when critically stressed;

disposing the second body of solid material adjacent the plunger plate; and enclosing in a frame at least one of the body of solid material, the second body of solid material, and the plunger plate.

* * * * *